United States Patent [19]

Turtle et al.

[11] Patent Number: 4,674,155

[45] Date of Patent: Jun. 23, 1987

[54] BUCKLES WITH STRUCTURE TO ALLOW UNIDIRECTIONAL MOVEMENT OF STRAP

[75] Inventors: Ivan R. Turtle, Melksham; Cyril N. E. Angell, Trowbridge, both of England

[73] Assignee: Avon Industrial Polymers Limited, Wiltshire, Great Britain

[21] Appl. No.: 743,938

[22] Filed: Jun. 12, 1985

[30] Foreign Application Priority Data

Jun. 12, 1984 [GB] United Kingdom ..... 8414966

[51] Int. Cl.[4] ..... A44B 11/12

[52] U.S. Cl. ..... 24/170; 24/191; 24/193

[58] Field of Search ..... 24/170, 171, 182, 191, 24/193, 265 BC

[56] References Cited

U.S. PATENT DOCUMENTS

| | | | |
|---|---|---|---|
| 378,555 | 2/1888 | Prym | 24/191 |
| 438,912 | 10/1890 | Day, Jr. | 24/170 |
| 686,982 | 11/1901 | Malins | 24/191 |
| 947,284 | 1/1910 | Sourek | 24/170 |
| 1,170,151 | 2/1916 | Hathaway | 24/191 |
| 1,393,721 | 10/1921 | Otten | 24/191 |
| 1,517,080 | 11/1924 | Lester | 24/191 |
| 3,162,914 | 12/1964 | Ireland | 24/170 |
| 3,328,856 | 7/1967 | Jonas | 24/191 |
| 3,466,668 | 9/1969 | Ochiai . | |
| 3,823,444 | 7/1974 | Takabayashi . | |
| 3,969,792 | 7/1976 | Hattori | 24/193 X |
| 4,233,713 | 11/1980 | Berg | 24/170 X |

FOREIGN PATENT DOCUMENTS

| | | | |
|---|---|---|---|
| 1557479 | 4/1970 | Fed. Rep. of Germany . | |
| 424577 | 5/1911 | France | 24/191 |
| 1387719 | 9/1963 | France | 24/191 |
| 17328 | 2/1908 | Norway | 24/191 |
| 895559 | 5/1962 | United Kingdom | 24/191 |
| 1400403 | 7/1975 | United Kingdom . | |

*Primary Examiner*—Peter A. Aschenbrenner
*Assistant Examiner*—Laurie K. Cranmer
*Attorney, Agent, or Firm*—Merchant, Gould, Smith, Edell, Welter, & Schmidt

[57] ABSTRACT

The pivoted jaws (2,3) of a buckle for a strap (4) are held together by fastening means (22,23) which define a first closed position of the buckle, but which are such as to allow closer approach of the jaws when they squeeze the strap between them. A moment is exerted, if the strap is pulled, between an edge (9) over which it is turned and which is offset from the pivot (10) and this has the effect of causing closer approach of the jaws and thus an increasedly positive hold. Teeth (20) on one of the jaws are of a saw-tooth profile to permit movement of the strap in one direction even when the buckle is closed. Both jaws may be respective one-piece integral plastics mouldings.

13 Claims, 3 Drawing Figures

BUCKLES WITH STRUCTURE TO ALLOW UNIDIRECTIONAL MOVEMENT OF STRAP

FIELD OF THE INVENTION

This invention relates to buckles which are for securing a strap to an anchor and which are of the type which allow either free adjustment of the strap through the buckle or a retention of the strap; but which in the retention position allow it to move in one direction but not in the other.

BACKGROUND OF THE INVENTION

The desiderata for this type of buckle are; free movement of the strap in the released condition of the buckle without, however, risk of the loss of the strap or of the buckle falling apart and; in the closed condition of the buckle a positive and foolproof closure which cannot be accidentally knocked loose but which allows the unidirectional movement of the strap through the buckle.

The commononest type of such buckle is a form where two metal loops of slightly different dimensions are pivotally secured to the anchor point and the strap is reeved around the loops. It can be released for free movement by manually pulling the loops apart; it is always moveable in one direction through the loops but in the other direction the loops are pressed together and resist the movement of the strap. The disadvantages of this type of construction are its lack of positiveness and the ease with which the strap can become lost or folded.

SUMMARY OF THE INVENTION

In the present invention the buckle has two jaws which are pivotally articulated together. The jaws are held together by fastening means which define a first closed position, but which are such as to allow closer approach of the jaws. A moment is exerted, if the strap is pulled in the prohibited direction, between an edge over which it is turned and which is offset from the pivot and this has the effect of causing closer approach of the jaws and thus an increasedly positive hold.

In a preferred embodiment, one of the jaws constitutes the guide for the strap and includes an edge lying to one side of the axis of articulation and generally parallel to it, over which edge the strap is adapted to be turned back approximately 180° in use. The second jaw of the buckle comprises at that side of the articulation axis a strap-engaging part which is able to be snapped into engagement with the guide part, the second jaw having teeth on its face adjacent to the strap. The teeth may have a saw-tooth configuration favouring movement of that length of the strap which lies between the two jaws, in the direction away from the pivot axis. The snap engagement of the second jaw is such that there is a first position of that engagement in which the teeth are in contact with the strap. However the second jaw is free even in the engaged positon to move about the pivot axis in relation to the guide part of the first jaw in such a way as to move the teeth into closer relationship with the guide part and thereby more firmly to engage the strap running between them. The second jaw is rigid through the articulation point with the anchor point of the buckle, and the said edge of the guide part is off-set from that plane which passes through the axis of articulation and is parallel to the run of the strap which lies between the two jaws. In this way, traction on that run of the strap which has been folded around the edge which does not lie between the two jaws exerts a moment upon the guide part of the buckle in relation to the tension exerted on that guide part through the articulation of the buckle and in reaction to tension exerted on the anchor point, so that the two jaws are urged into closer relationship and the teeth into firmer engagement with the strap entrapped beneath them.

A preferred form for the guide part is a channel section with overhanging lips along each lateral side to help entrap the strap and a window lying between the said edge of the guide part and the articulation, which preferably is formed as far as the first jaw part is concerned by a lateral bar parallel to the edge. A snap engagement can be assured between the first and second jaw by snapping the other jaw through and past the lips. For this purpose the lips and the corresponding parts of the second jaw may have corresponding overhang or dove-tail section to achieve a positive yet releasable engagement.

The anchor point on the other side of the articulation may be one adapted for attachment to a further strap.

The strap is particularly effectively a rubber strip or a webbing of elasticated fabric. Then the additional effect will be achieved of a thinning of the web when pulled in the permissible direction, assisting minimising of the engagement of the teeth with it.

The parts may be formed all of plastics material and in particular of polyacetal material.

DESCRIPTION OF THE DRAWINGS

A particular embodiment of the invention will now be described with reference to the accompanying drawings wherein.

DESCRIPTION OF A PREFERRED EMBODIMENT

Figure 1:
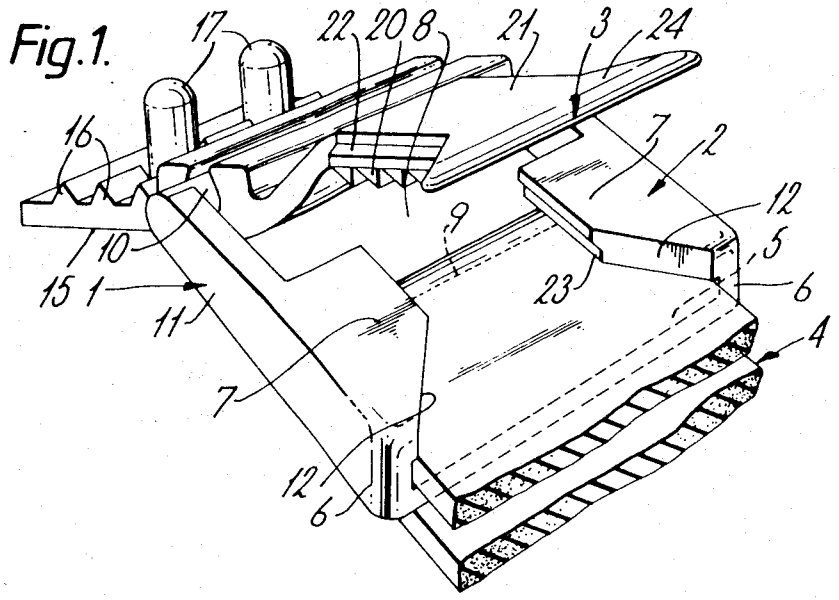
FIG. 1 is a perspective view showing the buckle in the open condition.

In FIG. 1 we see a buckle 1 having two parts offering a first jaw 2 and a second jaw 3. The first jaw 2 is primarily a guide part to guide a strap 4 and is of channel section with a wide base 5, shallow side walls 6 and inwardly projecting ledges 7 at the top of each side wall. A window 8 appears between an edge 9 of the base channel and a lateral bar 10, parallel to the edge 9 and which projects from arms 11 at the end of each side wall, offers a pivoting articulation with the other jaw. The centre axis of the lateral bar 10 is not in the plane of the base 5 of the channel.

The ledges may have tapered-away entry edges 12 to assist the initial threading of the strap 4 through the guide part.

Figure 3:
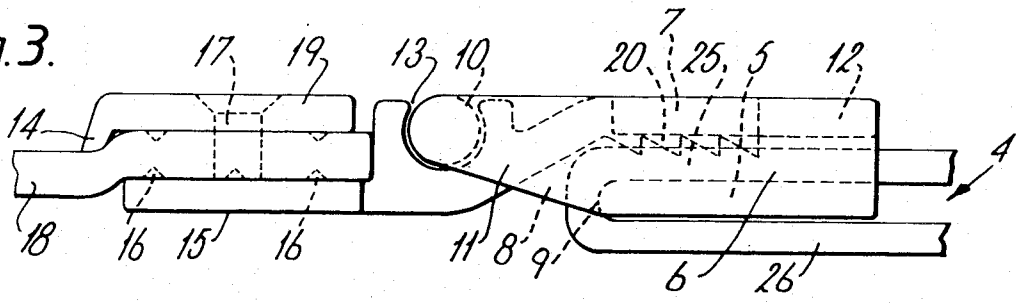
FIG. 3 is a side view of the buckle.
Figure 2:
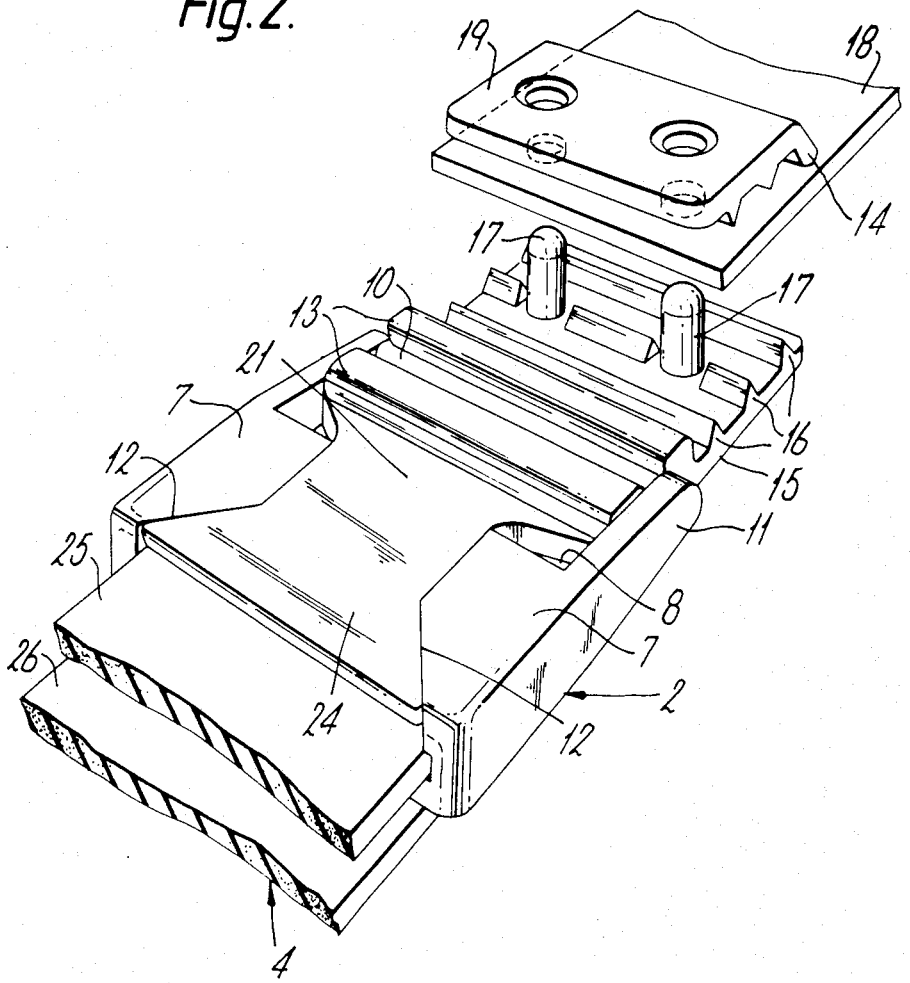
FIG. 2 is a perspective view showing it in the closed condition and with an anchor strap in exploded relation with it.

The second jaw 3 has a channel 13 for clipping and receiving the lateral bar and allowing pivoting articulation between the two jaws. At one side from that articulation the jaw 3 includes a plate 15 ribbed at 16 with two pins 17 projecting upwardly from it. This is, as better seen from FIGS. 2 and 3, for receiving a further strap 18 in which apertures may be made for the reception of the pins 17. There is a clamp plate 19 which is also ribbed and which has a terminal flange 14 to cause engagement and deflection of the strap 18, when the plate 19 is pressed down on the strap which has been threaded on the pin 17 and is held there by, for example, ultrasonic swaging or welding of the heads of the pins 17. Thus is formed the anchor of the buckle.

At the other side of the articulation the second jaw 3 has projections on its undersurface, in this embodiment teeth 20 of saw tooth profile. A stem 21 fits exactly in the mouth between the ledges 7 of the channel. The stem is wider nearer the base than remote from it, having downwardly divergent stepped or chamfered edges 22. The mouth is also wider nearer the base 5 than away from it, having corresponding overhangs (correspondingly stepped or chamfered) 23, on the ledges 7. A widening part 24 corresponds with the tapered away edges 12 of the ledges 7. In use, the strap 4 having been threaded through the guide may be freely adjusted while the buckle is in the open position. The buckle may then be clsoed by snapping the stem part 21 of the second jaw through between the ledges 7 where it is held in a first closed position by engagement between the mouth and the part 21. In this position the teeth 20 are in comparatively light contact with the run 25 of the strap 4 lying between the two jaws. The tension side of the strap is the lower run 26. If this is pulled on, two things happen. Initial contact of the acute side of the teeth with the upper run of the strap tends to prevent its movement. As tension increases a moment is exerted on the edge 9 in relation to the lateral bar 10. This has the effect of twisting the guide part 2 anti-clockwise as viewed in FIG. 3 in relation to the second jaw 3 which is rigid with the anchor point, where reaction is taken up against the tension exerted by the strap 4. The effect of this is that since there is no resistance in this direction from the already-engaged overhangs on the ledges 7 and stem 21 the two jaws are urged closer together and the degree of engagement of the teeth 20 with the run 25 of the strap is increased, thus even more firmly holding it against displacement. If, on the other hand, the run 25 of the strap is pulled away from the articulation axis the slanted faces of the teeth 20 offer little or no resistance to movement of the strap in that direction.

The buckle is particularly effective when the strap is of rubber or other elastic character. To allow for different thicknesses of strap the jaw part 2 may be modified by the provision of projections, such as longitudinal ribs, on the base 5 to space the strap appropriately upwardly.

Both jaw parts as well as the clamp may be made of integrally one piece of plastics material of suitable hardness characteristics. The buckle is particularly suitable for the securing and retention of personal harness for carrying equipment but clearly many other uses are available.

We claim:

1. A buckle comprising two relatively pivotable rigid parts (i) a first of said parts comprising (a) a first base plate, (b) a pair of side walls at opposite lateral sides of the base plate and extending upwardly therefrom and extending also longitudinally beyond one end of the base plate, (c) means defining an axis for said pivoting, said means joining said side walls in the portion longitudinally beyond the one end of the base plate and upwardly from the base plate, (d) ledges extending mutually inwardly from said side walls above said base plate to define a strap-receiving slot between them and the base plate, and edges of the respective ledges spaced apart to define a mouth, (ii) a second of said parts comprising (e) a second base plate, (f) an anchor on said second base plate;

(g) channel means for receiving said axis-defining means to provide said pivotability of the parts, (h) said channel means being borne on a part extending from the second base plate to a jaw portion, said channel means being between said jaw portion and said second base plate, (i) the jaw portion being positionable to be generally coplanar with said ledges, the dimensions of the jaw portion and of the mouth being such that the jaw portion may pass, with a snap action with said edges of said ledges, through the said coplanarity to and from closed and open conditions of the buckle, (j) projections on a surface of said jaw portion for engaging, in a closed condition on the buckle, a portion of a strap received flat in said strap receiving slot above said first base plate, (k) the anchor and jaw portion being respectively at different longitudinal sides of the channel means;

whereby to be responsive, in its closed, condition to tension on said strap tending to move said engaged portion of the strap away from said axis to draw said jaw portion pivotally from said coplanarity towards said first base plate.

2. A buckle as claimed in claim 1 wherein said projections are saw-tooth section ribs, the ribs having two faces extending parallel to the said axis, one of which is inclined and being nearer the axis.

3. A buckle as claimed in claim 1 wherein said channel means and axis defining means are snap-fitted together.

4. A buckle as claimed in claim 3 wherein both said parts are one-piece integral parts made of plastics material.

5. A buckle as claimed in claim 1 wherein said part bearing said channel means passes through a window defined by the space between said axis-defining means, said first base plate and said side walls.

6. A buckle as claimed in claim 5 wherein the said engaged portion of the strap is a free end portion of a run of the strap brought under the first base plate towards the axis and through said window between the base plate and the part bearing the channel means, said run being a side of the strap adapted to be held under tension.

7. A buckle for securing a strap and which has two jaws pivotally movable about a pivot between an open and a closed condition, allowing in the open condition substantially free movement of a strap through the buckle but in the closed condition allowing only unidirectional movement of such a strap, a first of the jaws including a guide part for receiving a strap, the guide part comprising a base plate terminating in an edge around which the strap is to be turned, a first run of the strap and a second run of the strap parallel to the first run, said edge defining a turn between said first and second runs, the second of the jaws including projections for pressing, in the closed condition of the buckle, on the second run of the strap between the jaws at a position further from the pivot of the jaws than the said edge is therefrom, means on said first and second jaws for interacting in a snap-fit relation between said jaws to define a closed condition of the buckle with the projections being a predetermined distance from the base plate, and the pivot of the two jaws being offset from the said edge of the first jaw whereby pressure exerted by said first run on said edge in the direction away from the pivot tends to draw the projections closer to the base plate than said predetermined distance.

8. A buckle according to claim 7 wherein the projections are saw-tooth in profile with a face inclined to and a face perpendicular to a plate of the jaw on which they are borne, the inclination being in the direction of permitted movement of a strap.

9. A buckle according to claim 7 wherein the pivot is defined by a bar on one jaw engaged by a channel on the other, the engagement of the channel and bar being by snap-fastening together.

10. A buckle according to claim 7 wherein each of the jaws is an integral one-piece moulding of plastics material.

11. A buckle according to claim 7, wherein the guide part includes side walls extending from said base plate and further includes ledges extending from said side walls, said ledges having a thickness and respective edges which taper outwardly towards said wall in said thickness toward the base plate, said edges defining a mouth therebetween, the secnd jaw having a mating portion with a width corresponding to said tapered edges and being formed to mate therewith, the mating portion being forceable through the mouth of the channel, thereby defining a first closed position.

12. A buckle according to claim 11 wherein the second of the jaws has, at a side of the pivot remote from where the projections are, anchoring means for acting as reaction means against pressure applied to said edge of said base plate.

13. A buckle according to claim 12 wherein the anchoring means is on a second base plate for attachment to a further portion of a strap.

* * * * *